US008340311B2

(12) United States Patent
Villarreal, Jr.

(10) Patent No.: US 8,340,311 B2
(45) Date of Patent: Dec. 25, 2012

(54) VOICE AMPLIFICATION SYSTEM FOR SIGNAL CALLING DURING THE PLAY OF A SPORTS COMPETITION

(76) Inventor: Hector C. Villarreal, Jr., San Antonio, TX (US)

( * ) Notice: Subject to any disclaimer, the term of this patent is extended or adjusted under 35 U.S.C. 154(b) by 1265 days.

(21) Appl. No.: 11/823,009

(22) Filed: Jun. 25, 2007

(65) Prior Publication Data

US 2008/0317263 A1 Dec. 25, 2008

(51) Int. Cl.
*H04R 1/10* (2006.01)

(52) U.S. Cl. ..... 381/74; 381/384

(58) Field of Classification Search ..... 381/77, 381/120, 92, 74, 122, 75, 311, 367, 375, 381/376, 309, 300, 361, 370, 79, 82, 301, 381/304, 333, 385, 386, 388, 91; 455/66, 455/351, 89, 344, 569.1, 90; 473/415, 222, 473/438; 2/425, 410, 455
See application file for complete search history.

(56) References Cited

U.S. PATENT DOCUMENTS

| | | | | |
|---|---|---|---|---|
| 2,904,645 | A | 9/1959 | Sarles | |
| 3,890,475 | A | 6/1975 | Denhart | |
| 4,070,553 | A * | 1/1978 | Hass | 381/301 |
| 4,084,139 | A * | 4/1978 | Jakobe | 381/4 |
| D249,508 | S | 9/1978 | Coughlin et al. | |
| 4,400,591 | A | 8/1983 | Jennings et al. | |
| 4,473,130 | A | 9/1984 | Korber et al. | |
| 4,491,699 | A | 1/1985 | Walker | |
| 5,142,700 | A | 8/1992 | Reed | |
| 5,493,697 | A * | 2/1996 | May | 455/66.1 |
| 5,815,579 | A * | 9/1998 | Boyden | 381/301 |
| 5,933,511 | A | 8/1999 | Garth, Sr. | |
| 6,015,160 | A | 1/2000 | Spector | |
| 6,101,256 | A * | 8/2000 | Steelman | 381/91 |
| 6,588,022 | B1 * | 7/2003 | Anders et al. | 2/421 |
| 6,940,984 | B2 * | 9/2005 | Carpenter | 381/75 |
| 7,035,422 | B1 * | 4/2006 | Wiener | 381/388 |
| 7,221,966 | B2 * | 5/2007 | Birli et al. | 455/569.1 |

* cited by examiner

*Primary Examiner* — Xu Mei
*Assistant Examiner* — Lun-See Lao
(74) *Attorney, Agent, or Firm* — Kammer Browning PLLC

(57) ABSTRACT

A system that allows the teammates of an individual (such as a quarterback on a football team) to hear signals being called by that individual during the course of a sports competition, despite noise generated by an audience. The system includes a microphone positioned within the helmet of the signal caller connected to an audio amplification device, either positioned in the helmet or in some other part of the clothing or equipment worn by the signal caller. The amplified signal is then directed to one or more loudspeakers, again positioned either on the helmet of the signal caller or on the clothing or equipment worn by the signal caller. The loudspeakers are directed to the signal caller's teammates, positioned typically along a line of scrimmage. The system may be time-limited in operation in that the signal caller must specifically activate the system which thereafter remains activated only for a pre-set period of time before automatically shutting off. The components of the system may be connected to each other by wired or wireless signal lines.

5 Claims, 7 Drawing Sheets

VOICE AMPLIFICATION SYSTEM FOR SIGNAL CALLING DURING THE PLAY OF A SPORTS COMPETITION

BACKGROUND OF THE INVENTION

1. Field of the Invention

The present invention relates generally to systems for the amplification of the human voice and the broadcast of that amplified sound. The present invention relates more specifically to a system for the amplification and broadcast of a signal caller's voice during the play of a sports competition for the purpose of overcoming crowd noise.

2. Description of the Related Art

Any sports competition that is based upon a group of players acting as a team will rely upon the ability of the players on the team to communicate with one another during the play of the game. Different sports provide different opportunities for players to communicate with one another in an effort to set forth the manner in which the players will carry out the play of the game or to set overall strategy during the play of the game. Most sports activities provide for some type of pause or "time out" during the play of a game wherein players may communicate with one another using a normal voice outside of the hearing of players from the opposing team. Frequently such opportunities for confidential communication of planned actions, strategies, and instructions are sufficient to allow a team to efficiently operate and carry out its game plan.

In many cases, however, the game play situation might change at a point during the play of the game where the team might not have the opportunity to likewise change its plans, strategies, or instructions. Such might occur, for example, in the game of American football where an offensive team, having a planned play in mind, approaches the scrimmage line only to find the defense lined up in an adverse array of positions that would not be conducive to carrying out the planned play. Under such circumstances, the quarterback (signal caller) in American football will frequently attempt to change the planned play in response to the defense that the team is presented with. The quarterback may communicate changes in the planned play to the other players on the team by means of calling out certain signals known to the players on the team to indicate certain instructions or directions contrary to the previously communicated planned play. It is important, therefore, for the quarterback or signal caller to be able to communicate clearly to the other players on the team in the event that a change in the planned play might occur.

Even without the necessity of changing a planned play during the play of a game, it is desirable for a team in many sporting events to be able to initiate a play during the game at a point in time of its own choice such that the opposing team may in some manner be caught off-guard. An example of this might again be found in the play of the game of American football wherein the offensive team approaches the line of scrimmage and takes position for the play but does not initiate the play until the signal caller calls the agreed upon signal to initiate the play. In the game of American football, the play is initiated when the player in the center position on the offensive team hikes or hands the football to the quarterback from a point on the ground at the line of scrimmage. It is, therefore, important that the offensive center at least be capable of hearing the signal calling made by the quarterback. In fact, most of the other players on the offense initiate their action not by viewing the movement of the football by the offensive center but rather by likewise listening to the signal calling and initiating their movement only after the appropriate signal has been called by the quarterback. It is, therefore, equally important for the remaining members of the offense in American football to hear the signal calling of the quarterback even if no change in the planned play is being made.

When sporting competitions are carried out before an audience of fans, the ability of the players on a team to hear the signal calling made by the quarterback or other signal caller can become challenged by the sometimes loud noise created by the crowd. In fact, in many major sporting events a crowd's awareness that it can alter the play of the game by inhibiting the ability of one team's players to hear signal calling, simply increases the possibility that the crowd noise will exceed a level that would otherwise permit team members to communicate among themselves.

A number of systems have been developed in the past that allow individuals to communicate with one another over some distance with and without the need to overcome extraneous noise. Some such systems simply try to provide an individual with the ability to communicate in a normal voice to another individual positioned at some great distance away. Other such systems are directed to allowing an individual the ability to communicate to a large group of people at one time. These existing systems generally take one of two forms. A first type of system incorporates some type of wired or wireless communication whereby the voice of a first individual is picked up by a microphone positioned on that individual and a radio frequency signal is generated to transmit a signal representative of the sound of the voice over a distance to a radio frequency receiver. The receiver then recreates the sound of the first individual's voice into a speaker or headphone associated with the second individual positioned at a distance from the first. Such broadcasts may, of course, occur between two individuals or between a first individual and a large number of other individuals, each of whom might have a receiving unit and earphones or speakers positioned on them.

A second type of system that has been developed in the past might simply be referred to as the public address or "PA" system. These efforts have been directed to providing an individual with a means for amplifying his or her voice and projecting that amplified voice over a large area that may or may not be experiencing extraneous noise at the same time.

The most significant problem associated with the first category of prior efforts in the field, namely that of utilizing radio frequency communication between individuals, is that such systems are typically prone to failure especially when the systems are subjected to extreme conditions such as often occur during the play of a contact sporting event. These systems rely upon the operation of both the transmitting unit and the receiving unit for their appropriate function. Failure of either unit will cause the entire system to fail. In addition, establishing transmitting and receiving units with each and every player on a team becomes a high cost endeavor in terms of both initial set-up and ongoing operational maintenance. Such radio frequency communication systems, therefore, although many have been applied to sporting events, are not in common use because of the failings described.

The primary problem with most public address (PA) systems is that they are designed to be used under conditions where the speaker is stationary and is able to position themselves next to the bulky, and often complex, equipment required to receive, amplify and project the sound of the user's voice. Such public address voice amplification systems generally require microphones, amplifiers, power supplies, and speakers, as well as the necessary cabling extending between these components. Amplifiers capable of generating sound levels sufficient to overcome even modest extraneous noise, or to extend over even modest distances, have generally been quite large in configuration and have required significant power in order to convert the electronic signal associated with the voice (received by the microphone) into an audio wave capable of traveling great distances through the air while maintaining a significant amplitude.

Improvements have been made in recent years to the quality and capacity of speakers that have allowed for the use of smaller speaker configurations to generate ever larger volumes of sound. These speakers have not only improved frequency response but are capable of handling higher powered inputs and are therefore capable of generating higher decibel outputs. In a similar manner, power supplies have likewise been improved such that direct current power sources such as batteries and the like are enclosed in smaller packages while maintaining the same or increased power outputs. Many of the improvements in the above reference technologies have been driven by the cellular phone market whereby increased battery life and power output is being demanded along with increased quality of speaker output with higher amplification levels.

Systems that have been designed and used in the past to permit a signal caller to communicate to other players during the play of a sporting competition, have not heretofore taken advantage of the improvements in both speaker technology and in power supply technology, at least not to the point of permitting the use of smaller, more compact and rugged public address personal voice amplification systems. Most systems currently available for sporting events to allow the signal caller to communicate with the other players on the team still focus on the use of radio frequency communication devices. Those that do rely upon voice amplification systems associated directly with the signal caller fail to adequately integrate the system into the equipment being worn by the signal caller in such a way that allows for its safe operation and its resistance to damage by contact during the play of the game. There is a need, therefore, for a compact self-contained voice amplification system that is rugged and resistant to damage in the face of the normal play of a sporting event whereby a signal caller may communicate with other players on the team even in the face of elevated crowd noise that might otherwise prevent such communication.

Although the present invention is described herein primarily in conjunction with the game of American football, the basic principles lend themselves to other types of sporting events wherein communication between the players may be required and difficulty in carrying out the same exists because of crowd noise. The system of the present invention is distinct from existing systems that incorporate wireless communications between individual players in that it need not rely upon the effective operation of more than one electronic device.

Most of the efforts in the past are related to either hands-free loud speaker systems wearable by the user or hands-free wireless communication systems, again wearable by the user. These include systems described in the following U.S. Patents:

U.S. Pat. No. 5,493,697 issued to May on Feb. 20, 1996 entitled Communications System for the Game of Football Including Player-Carried Transmitter and Side Lines Speakers for Overcoming Spectator Noise describes a wireless communication system that includes a microphone and transmitter positioned in the helmet of the quarterback and a radio receiver positioned on the sideline of the field that receives the transmitted signal of the quarterback's voice and amplifies it to be broadcast through an arrangement of speakers positioned on the sidelines near the line of scrimmage toward the quarterback's teammates.

U.S. Pat. No. 6,940,984 B2 issued to Carpenter on Sep. 6, 2005 entitled Hands-Free Megaphone describes a system that is not specifically configured for use in conjunction with a sporting event, but rather for broadcasting the user's voice through an arrangement of loudspeakers worn in a belt assembly as in an emergency situation. A microphone/earphone device is positioned on the head of the user with a wire extending to a belt which incorporates a battery compartment, an amplifier, a siren, and an on/off switch.

U.S. Pat. No. 3,890,475 issued to Denhart on Jun. 17, 1975 entitled Self-Contained Voice Amplification Headgear describes a hands-free voice amplification system that is incorporated entirely onto the helmet or hat of the user. It includes a megaphone horn with integral amplification circuitry as well as a drop down microphone that is positioned in front of the user.

U.S. Pat. No. 4,400,591 issued to Jennings et al. on Aug. 23, 1983 entitled Simulated Space Helmet describes a novelty item that is essentially a helmet which incorporates a microphone, a voice amplification system, and a loudspeaker positioned on the outside of the helmet. Audio electronics that modify the sound of the voice are intended to simulate an alien sound.

U.S. Pat. No. 4,491,699 issued to Walker on Jan. 1, 1985 entitled Communication Apparatus for Hostile Environments describes a system that provides a set of communication devices intended to offer both wireless transmission of the user's voice by radio frequency signal and local audible broadcast of the user's voice through an amplified speaker system.

U.S. Pat. No. 5,142,700 issued to Reed on Aug. 25, 1992 entitled Protective Helmet Containing an Integral Transceiver describes a football helmet (motorcycle helmet, construction helmet, or the like) that incorporates a transceiver system permitting two-way wireless communication between persons in the same location or with a remote base unit.

U.S. Pat. No. 4,473,130 issued to Körber et al. on Sep. 25, 1984 entitled Crash Helmet with Communication System describes a helmet for use by motorcycle drivers and riders that incorporates flexible acoustic tubes that extend from mouthpiece and earpiece components structured as sound amplifying shells and connect to a second similarly configured helmet though a quick-release coupling. This permits communication between the wearers without the need for electronic amplification devices.

U.S. Pat. No. 6,015,160 issued to Spector on Jan. 18, 2000 entitled Combined Safety Helmet and PA System describes a helmet typically intended for a bicyclist that incorporates a miniature public address system that allows the bicyclist to broadcast his or her voice to those within hearing range of the system. A compact amplifier and loudspeaker unit is clipped onto the waist belt of the bicyclist and connected to the microphone through a line extending through and behind the helmet. Power for the unit is supplied by a battery that is mounted on the frame of the bicycle.

U.S. Pat. No. 5,933,511 issued to Garth, Sr. on Aug. 3, 1999 entitled Hands-Free Amplification System describes a voice amplification system for use with a device (such as a face mask or a breathing mask) that obstructs the mouth of the user. This system includes a microphone that picks up the voice of the user through the user's ear and a cord extending to an amplifier and a speaker device positioned on a cord hung around the user's neck.

As indicated, the above described systems generally fall into one of two categories. A first more common system configuration involves wireless communication between a microphone and transmitter positioned on the signal caller and a receiver earphone positioned on the signal caller's teammates. The Reed patent provides a typical example of this type of communication, be it one-way communication transmitting the voice from the quarterback to his teammates, or two-way communication, back and forth between teammates.

A second category of systems disclosed involves the transmission of the signal caller's voice to some location on the sidelines, either to allow communication with coaches, or to broadcast the signal caller's voice through speakers positioned on the sidelines. The May patent provides an example of such a system. Other examples that allow wireless communication between coaches and the quarterback are quite common.

A third category of patents involves hands-free, voice amplification systems, not necessarily intended for use in conjunction with sporting events. Perhaps the best example of this is the Carpenter patent that basically describes an electronic megaphone positioned on a belt worn by the user and connected to a microphone positioned on the user's head. The Denhart and Walker patents likewise disclose such audio broadcast systems. The Spector and Garth, Sr. patents also provide hands-free voice amplification systems, although they involve components not fully positioned on the user.

There remains a need, therefore, for a communication system capable of broadcasting the voice of a signal caller to the signal caller's teammates, despite an elevated level of crowd noise. It would be preferred if such a system could be fully integrated into the equipment or clothing worn by the signal caller. The simplicity of such a system would be facilitated if all of the components required for operation were included in only the equipment worn by the signal caller. In other words, it would be beneficial if no radio frequency communication link between the signal caller and the other players on the team was required. It would be useful to take advantage of improvements in audio speaker and power supply (battery) technologies that allow for reduced size and increased output suitable for a self-contained system to operate at audio output levels sufficient to overcome crowd noise. It would further beneficial if such a system were rugged and required low maintenance in order to operate even under adverse conditions during contact sporting events.

SUMMARY OF THE INVENTION

A system that allows the teammate players of an individual (such as a quarterback on a football team) to hear the game play signals being called by that individual during the course of a sports competition, despite noise generated by the audience in the stands. The system includes a microphone positioned within the helmet of the signal caller connected to an audio amplification device, either positioned in the helmet or in some other part of the clothing or equipment worn by the signal caller. The amplified signal is then directed to one or more loudspeakers, again positioned either on the helmet of the signal caller or on the clothing or equipment worn by the signal caller. The loudspeakers are directed to the signal caller's teammates, positioned typically along the line of scrimmage, who might otherwise not hear the un-amplified voice of the signal caller over the crowd noise.

The system may be time-limited in operation in that the quarterback or signal caller must specifically activate the system which thereafter remains activated only for a pre-set period of time before automatically shutting off. Such a process ensures that amplification of the signal caller's voice is not inadvertently carried out at the wrong time during the play of the game. The components of the system may be connected to each other by wired or wireless signal lines.

DETAILED DESCRIPTION OF THE PREFERRED EMBODIMENTS

The following detailed description focuses primarily on the use of a system defined by the present invention in conjunction with the play of the game of American football. Football sporting events provide a primary example of a situation where use of the system of the present invention might be most beneficial. It will be understood, however, that any of a number of other sporting events could likewise utilize the system of the present invention to great advantage to allow for communication between the players in spite of extraneous noise. Those skilled in the art will recognize, therefore, that components of the present system that appear to be designed for integration into American football equipment (such as helmets, shoulder pads, etc.) could likewise be implemented in conjunction with alternative equipment for alternative sporting events. The sport of American football has been chosen to exemplify the various embodiments of the present invention primarily because it lends itself most appropriately to utilization of each of the various embodiments under different situations.

Figure 1:
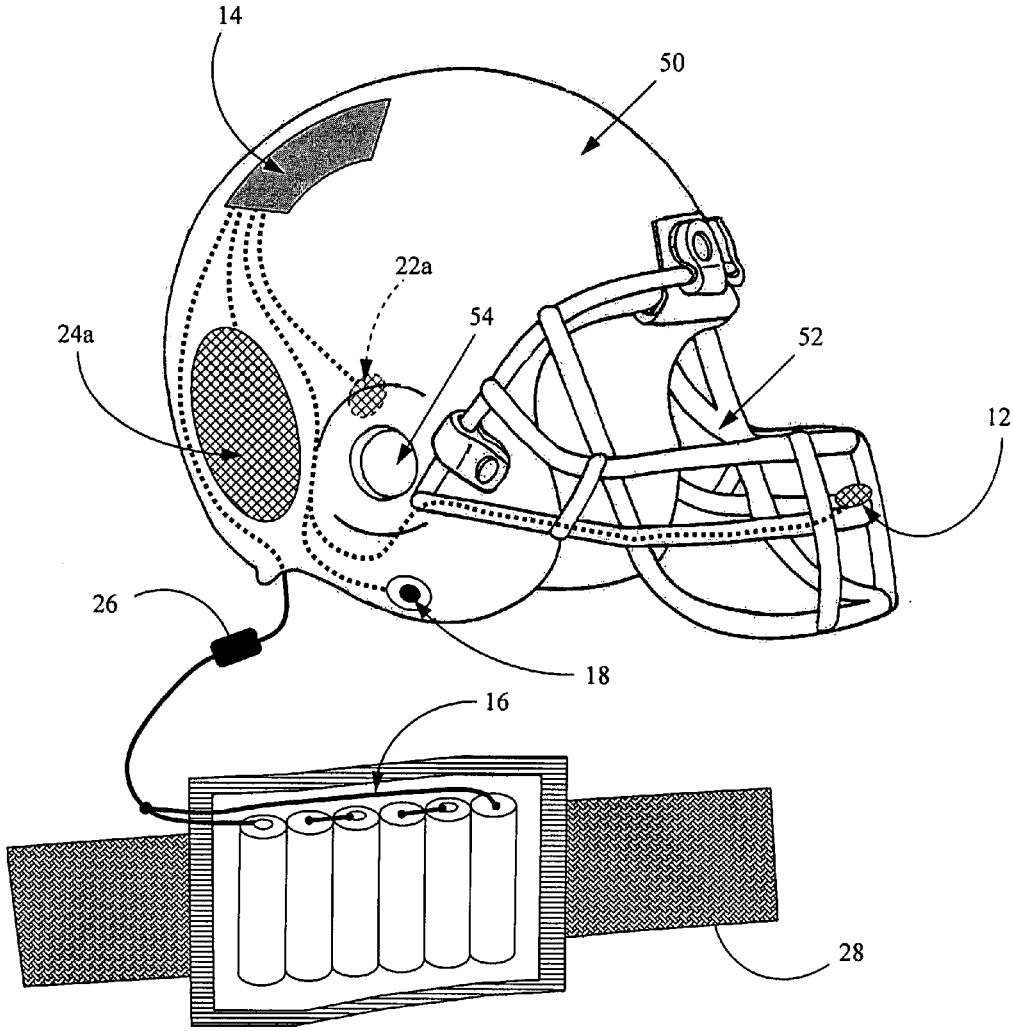
FIG. 1 is a perspective view of a first preferred embodiment of the present invention integrated into a helmet designed for use in American football (by the quarterback).

Reference is made first to FIG. 1 for a description of a first basic embodiment of the system of the present invention utilized in conjunction with a football helmet and a belt such as might be worn by the quarterback on the offense for a football team. The system is integrated almost entirely into helmet 50 which includes facemask 52 and ear aperture 54. This typical football helmet construction allows for the easy integration of the components of the present invention without the requirement of significantly modifying the structure of existing football helmets. Likewise, the components of the present system may be integrated into a typical football helmet without compromising the integrity of the helmet or its function as a safety device for use by the wearer.

Integrated on the inside surface of helmet 50, positioned between the shell of the helmet and any internal padding, is amplifier/controller circuitry 14. Connected to this circuitry 14 are microphone 12, control switch and/or volume control 18, feedback speaker 22*a*, and broadcast speaker 24*a*. In addition, power is provided to amplifier/controller circuitry 14 by way of a cable incorporating quick disconnect 26 to power supply 16. In this embodiment, power supply 16 is positioned on and supported by belt 28 that is worn by the user. In an alternate embodiment, still incorporating the system shown in FIG. 1, power supply 16 may be positioned on and supported by shoulder pad equipment (not shown in this view) that is worn by the user. Such a system would appear similar to the system shown in FIG. 5 (and described in more detail below) albeit with only the battery pack 16 integrated into the shoulder pads.

The circuitry required in amplifier/controller circuitry 14 is relatively straightforward from an electronic standpoint. The voice of the wearer is received into microphone 12 positioned (in this embodiment) in facemask 52 of helmet 50 worn by the user. Small wires may pass on or through the components of facemask 52 to a point interior within helmet 50 where they connect to amplifier/controller circuitry 14. Likewise, small gauge wires may connect amplifier/controller circuitry 14 to both feedback speaker 22*a* and broadcast speaker 24*a*. It is understood that a matching feedback speaker (22*b*) and a matching broadcast speaker (24*b*) may be positioned on an opposite side of helmet 50 not seen in the view shown in FIG. 1.

Control over amplifier/controller circuitry 14 by the user is maintained through the manipulation of control switch and/or volume switch 18. This toggle switch or rotary switch may be manipulated by the user to turn the system on or off and/or to adjust the volume of the sound generated by the system. Use of the system in this manner is described in more detail below.

Power to operate the system is used primarily to amplify the voice signal for the purposes of broadcasting from broadcast speaker 24*a* and is provided by battery power supply 16. Once again, this power supply, because of its typical size, might best be maintained and carried on a belt worn by the user. A small cable may pass beneath the clothing and equipment of the user through quick disconnect 26 into helmet 50 as shown. Not only is this arrangement practical because of the size typically required for power supply 16 but because the single component in the system most frequently requiring replacement will be the power supply when the batteries run down. Replacement of the battery power supply 16, therefore, may be carried out by simply disconnecting quick disconnect 26 and re-connecting a new power supply attached to belt 28.

Variations on the placement of the microphone 12 and the broadcast speakers 24*a* and 24*b* are anticipated. Because there are a variety of facemask configurations, especially for quarterbacks, placement of the microphone may benefit from being removable such as on a clip or other attachment device positioned on the facemask bars. Feedback speakers 22*a* and 22*b* might likewise be positioned in any of a number of different places within the helmet most suitable for hearing such feedback sounds for a particular user.

Perhaps more importantly, broadcast speaker 24*a*, in addition to having a matching broadcast speaker 24*b* positioned on an opposite side of helmet 50, might include a third speaker (not shown) directed towards the back of the helmet for purposes of projecting the sound towards team members positioned behind the signal caller. As described in more detail below in conjunction with FIG. 3, it is frequently the case where team members are in any of three different directions from the signal caller at a given point in time. Different sports might likewise require different configurations for these broadcast speakers such that team members positioned in their normal playing positions would best receive the broadcast sounds.

Figure 2:
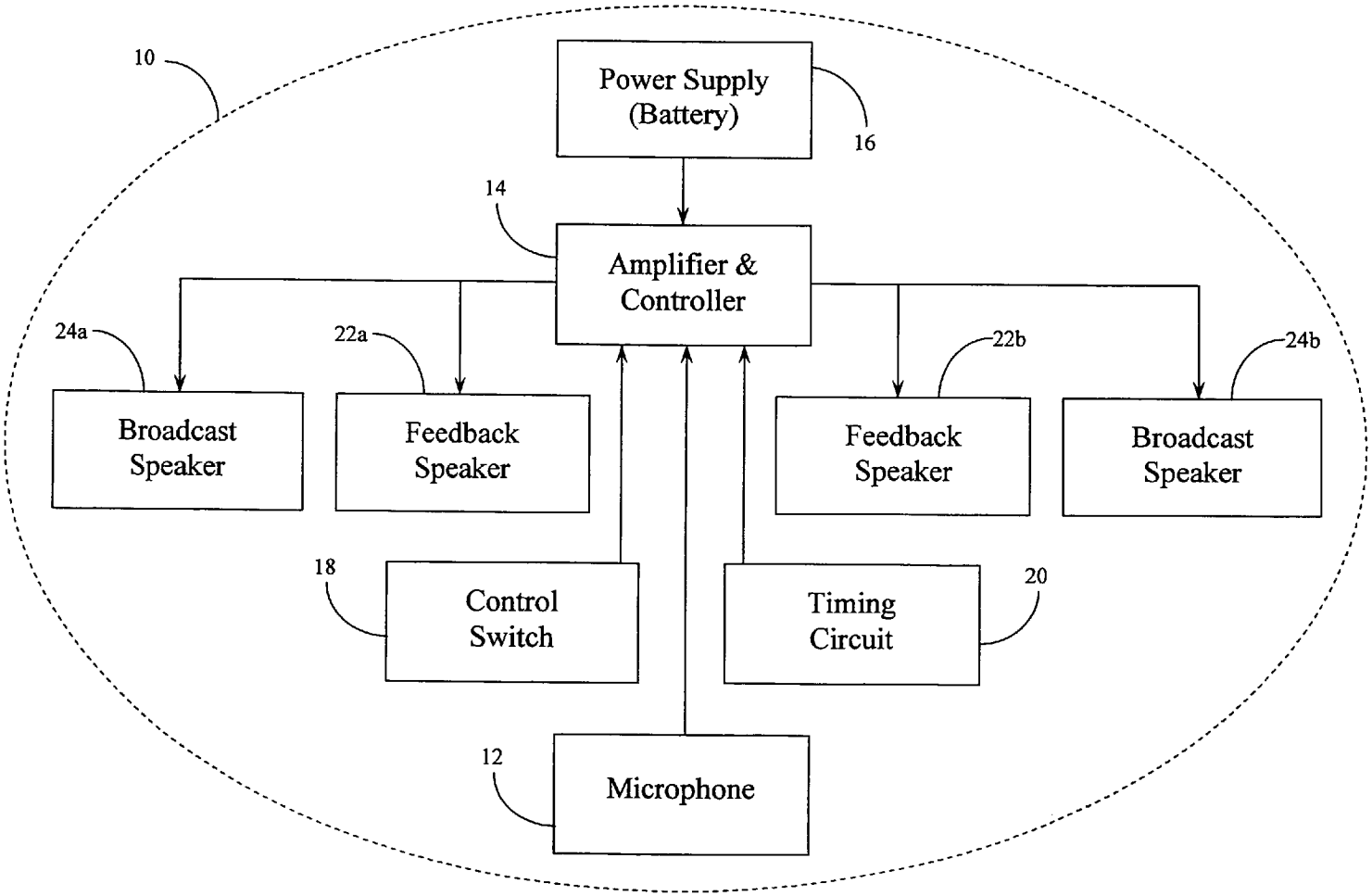
FIG. 2 is a schematic block diagram of the complete system of the present invention disclosing the basic electronic/electrical components and connections.

Reference is now made to FIG. 2 for a brief description of the basic electronic/electrical components and connections associated with the operation of the voice amplification system of the present invention. Voice amplification system 10 is generically comprised of microphone 12, which provides the electronic signal representation of the voice of the user to amplifier/controller circuitry 14. Amplifier/controller circuitry 14 receives its power from power supply (battery) 16. All components within the system are connected to amplifier/controller circuitry 14 and, therefore, receive any power required (such as with the broadcast speakers) from power supply 16 by way of amplifier/controller circuitry 14.

Additional inputs to amplifier/controller circuitry 14 are provided from control switch/volume control 18 as well as from timing circuit 20 whose function is described in more detail below. Outputs from amplifier/controller circuitry 14 are generally provided directly to feedback speakers 22*a* and 22*b* as well as broadcast speakers 24*a* and 24*b*.

Figure 3:
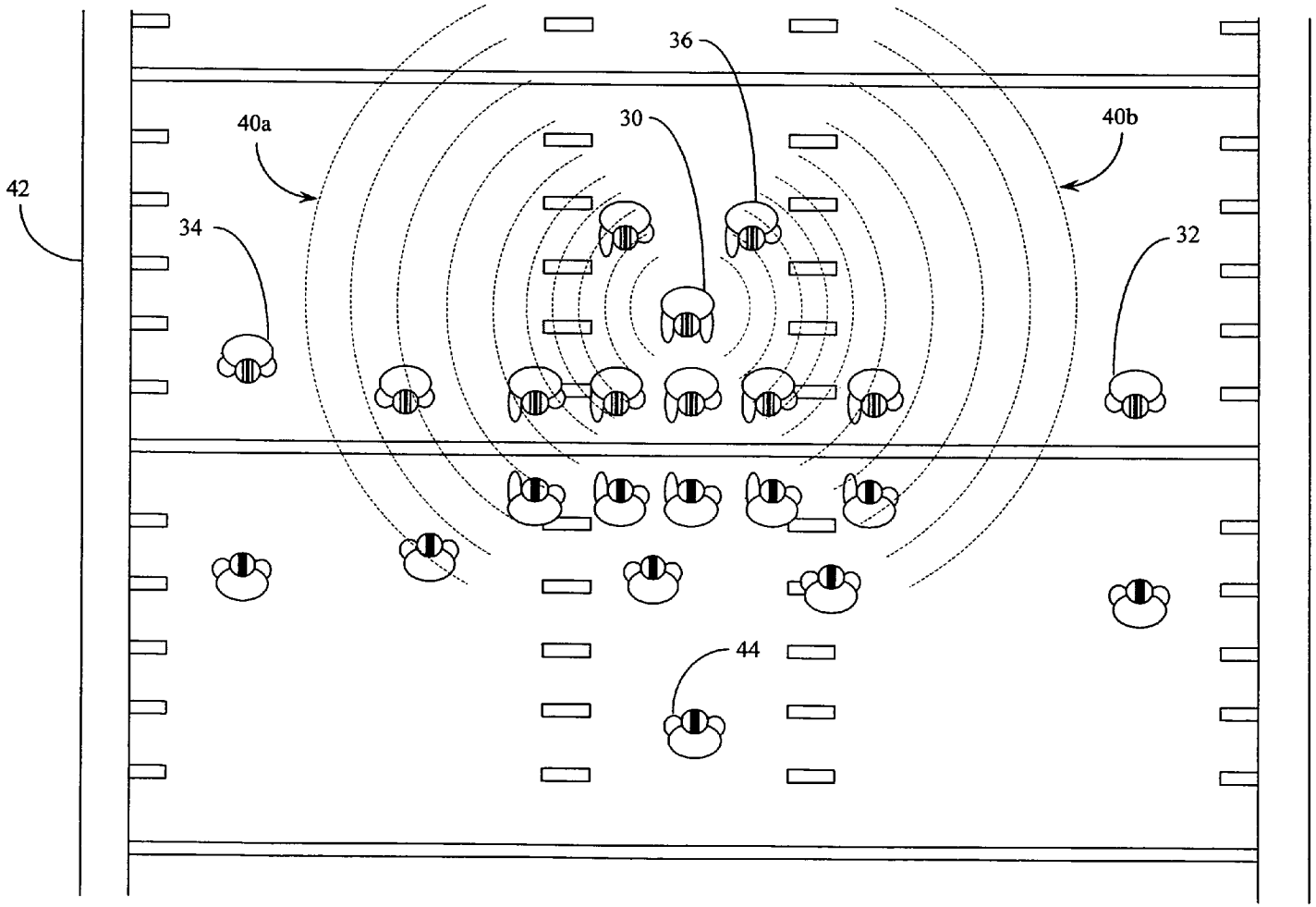
FIG. 3 is a schematic, top plan view of a typical field of play for the game of American football showing the manner of implementation of the system of the present invention.

Referring to FIG. 3, a better understanding of the use of the system of the present invention might be achieved by a description of the various positions of the players on a typical football team as a representative sporting event. In FIG. 3 a plan view of a section of a football field is provided. The field itself is bounded by sidelines 42 between which the various players on the offense and defense position themselves on either side of the line of scrimmage. In this example, the quarterback signal caller 30 is centrally positioned in the field of view. The remaining players on offense associated with quarterback signal caller 30 are seen along one side of the line of scrimmage. These players include a wide receiver 32 (as an example) and a second distant team member 34 positioned adjacent sideline 42 on the field of play. An additional relevant backfield player 36 is positioned generally behind quarterback signal caller 30 while signals are being called. Sound waves 40*a* and 40*b* generated by the system of the present invention, which is integrated into the equipment worn by quarterback signal caller 30, are shown as they project outward towards each sideline 42. In this manner sound waves 40*a* and 40*b* reach the most distant team members 32 and 34 such that the quarterback 30 is capable of communicating signals to these most distant players. While the quarterback signal caller 30 may not be trying to prevent the opposing team (the defense) from hearing the signals being called, the orientation of the broadcast speakers in the system of the present invention is such that opposing team player 44, as an example, is not necessarily subjected to the same level of sound waves as the other members of the team associated with the signal caller.

Figure 4:
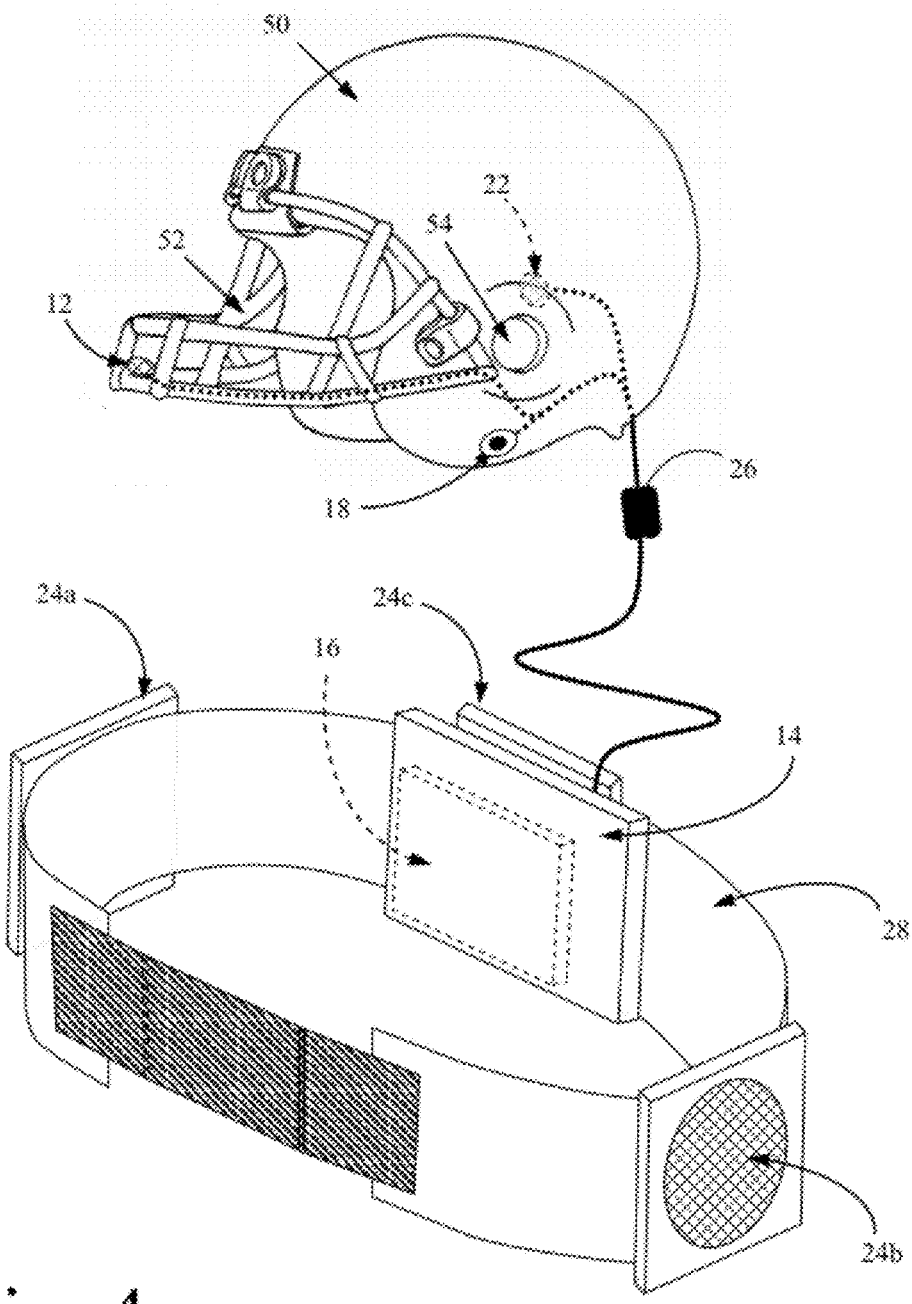
FIG. 4 is a perspective view of a second preferred embodiment of the present invention integrated into a helmet designed for use in American football (by the quarterback) with an associated belt to be worn by the signal caller (quarterback).

Reference is now made to FIG. 4 for an alternative embodiment of the system of the present invention wherein most of the components described above are integrated into a belt worn by the user rather than into the helmet worn by the user. In this embodiment shown, the minimal components associated with helmet 50 are microphone 12, which again is positioned on facemask 52, and feedback speaker 22 which is again positioned adjacent ear aperture 54 on helmet 50. Control switch volume control 18 is (in one version of this embodiment) still positioned on helmet 50 although a similar switch component might just as easily be incorporated into belt 28 for access by the user. Positioning switch 18 on the helmet in this embodiment does prevent the switch from being inadvertently activated or de-activated through contact during the pay of the game.

Quick disconnect 26 now carries the signal cables between helmet 50 and belt 28 rather than simply the power supply cables as described in the previous embodiment. In this embodiment, belt 28 integrates amplifier/controller circuitry 14 and power supply 16 which is directly associated with circuitry 14. Broadcast speakers 24*a* and 24*b* in this embodiment are positioned on opposing sides of belt 28 approximately where the hips of the user would be. This positioning serves to broadcast the sound to either side of the user as may be required according to the position of the other players on the team, again as described above. In the embodiment shown in FIG. 4 a third broadcast speaker 24*c* might likewise be incorporated into a rearward facing section of belt 28 for projection of the amplified sound of players in the backfield on the user's team. In general, the broadcast speakers may include three broadcast speakers, two of which are oriented in generally opposing directions from each other and the third oriented orthogonally to the first two. Belt 28 may be attached to and secured to the user in any of a number of different known manners, such as with elastic straps, Velcro®, or the like.

Figure 5:
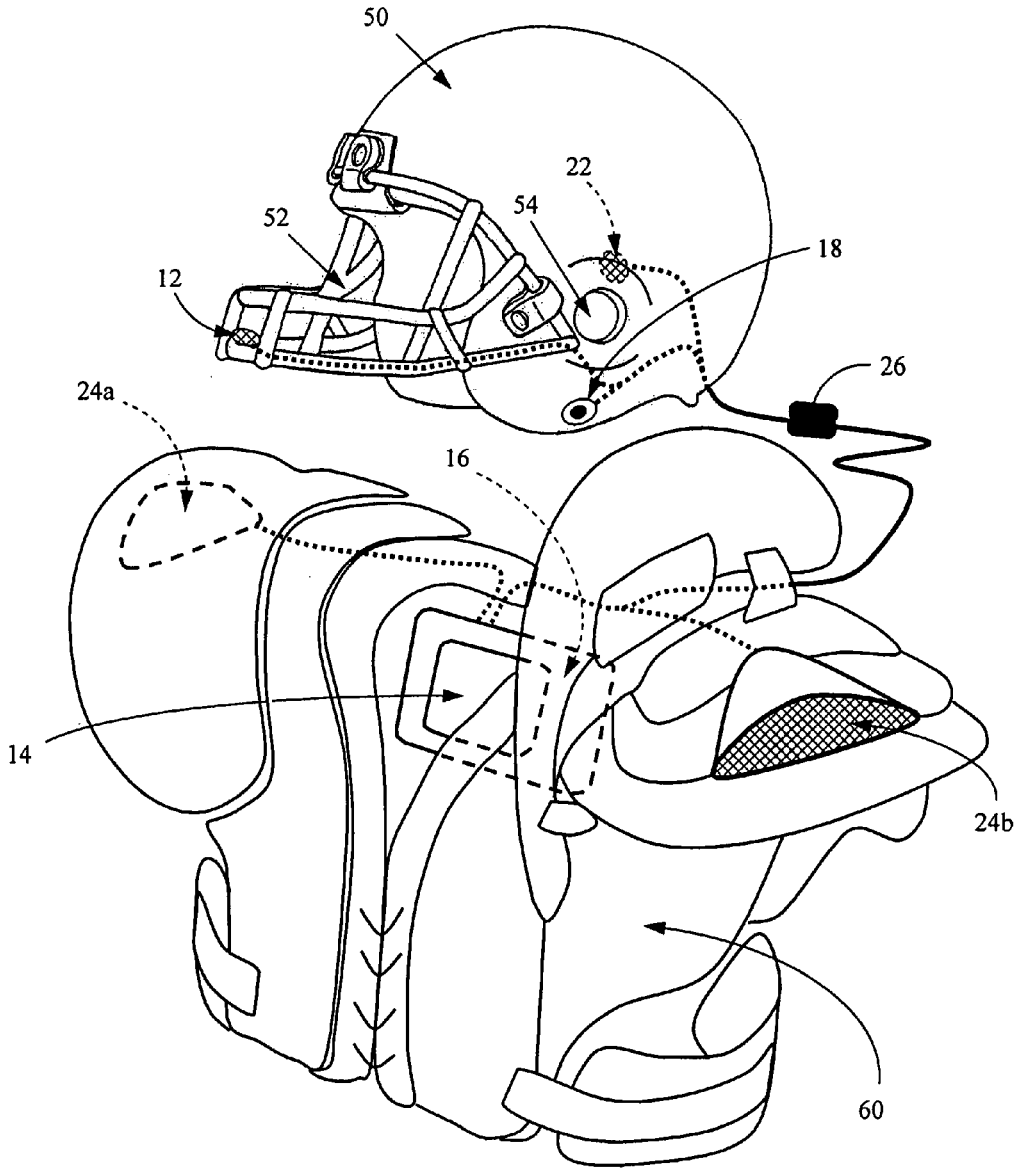
FIG. 5 is a perspective view of a third preferred embodiment of the present invention integrated into the helmet designed for use in American football (by the quarterback) and further in association with the shoulder pads typically worn by the signal caller (quarterback).

Reference is now made to FIG. 5 for a further alternative embodiment wherein the majority of the components of the system of the present invention are incorporated into the shoulder pads of the user. Such an alternate embodiment is made possible because of the significant volume and mass typically associated with shoulder pads in, for example, the play of American football. Shoulder pads are generally constructed of multiple layers of rigid plate-like components in association with more flexible interconnecting web components that together allow for a cushioned effect when the rigid components are impacted externally. These layers of rigid and soft components lend themselves to the creation of relatively large volumes of space between the layers and within which the various components of the system of the present invention might be placed.

Likewise, the structure of the shoulder pads associated with American football lend themselves to the placement of broadcast speakers 24*a* and 24*b* in much the same manner that they would be placed on belt 28. Shoulder pads 60 may integrate broadcast speakers 24*a* and 24*b* in any of a number of different locations on the equipment. In the view shown in FIG. 5, broadcast speakers 24*a* and 24*b* are integrated as layers into the overlapping shell-like components of shoulder pads 60 in order to provide some protection for the equipment. Wires connect broadcast speakers 24*a* and 24*b* to amplifier/controller circuitry 14 which is directly connected to power supply 16. The combination of amplifier/controller circuitry 14 and power supply 16 may be integrated into a flat cushioned package that is positioned beneath the padding of the shoulder pads in a location least likely to be subject to impact during the play of the game. The drawing of FIG. 5 suggests one such location, although alternate placements of circuitry 14 and power supply 16 are anticipated.

Variations on the embodiment shown in FIG. 5 include placement of control switch volume control 18 on the shoulder pads in direct connection to amplifier/controller circuitry 14 as opposed to being connected through quick disconnect 26 from the position on helmet 50. Alternate placements of broadcast speakers 24*a* and 24*b* are also anticipated and may include padded areas located on the lower sides of shoulder pads 60 and may further include a third broadcast speaker (not shown) positioned on the back of the shoulder pads to direct sound towards the players in the backfield.

Figure 6:
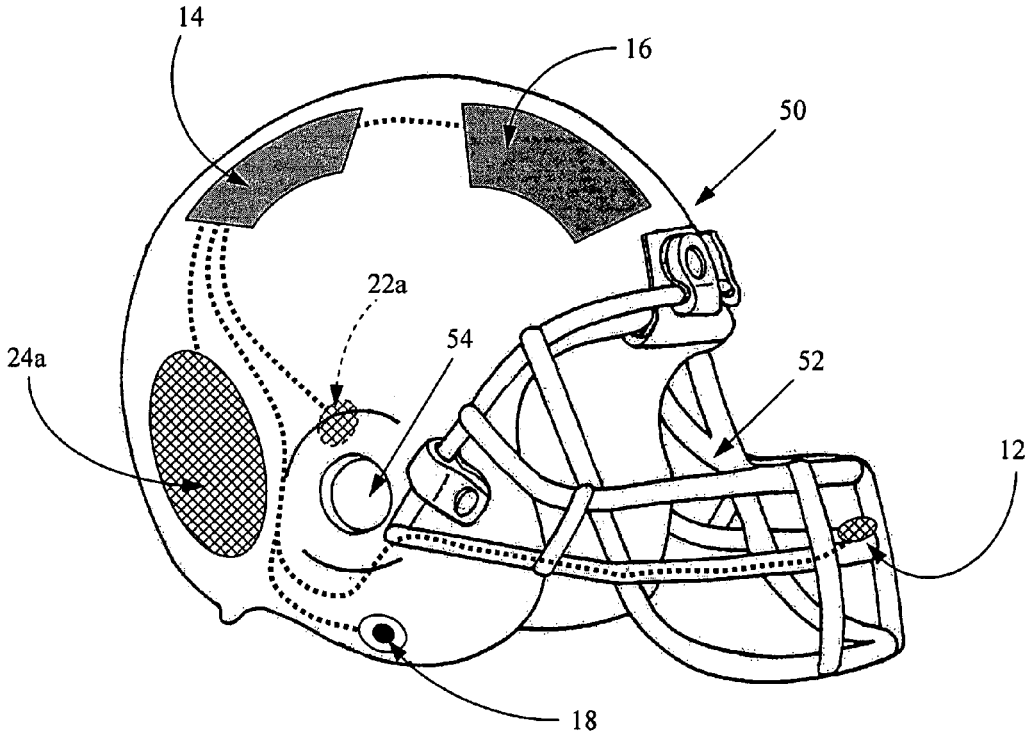
FIG. 6 is a perspective view of a fourth preferred embodiment of the present invention wherein all the components of the system are integrated into the helmet designed for use in American football (by the quarterback).

Reference is now made to FIG. 6 for a description of a further alternate embodiment wherein all of the components of the system of the present invention are incorporated into the helmet of the user. In this case, power supply 16 in the form of a battery pack is actually positioned within helmet 50 in a manner that, once again, does not compromise the integrity of the helmet and does not provide a safety hazard to the user. Such an embodiment would perhaps require more frequent exchange of batteries as the size of the power supply capable of being integrated into the helmet would be limited. The benefit of this alternate embodiment, however, is the elimination of any connecting cables between components such as might be placed on the belt or shoulder pads connecting to the helmet.

Figure 7:
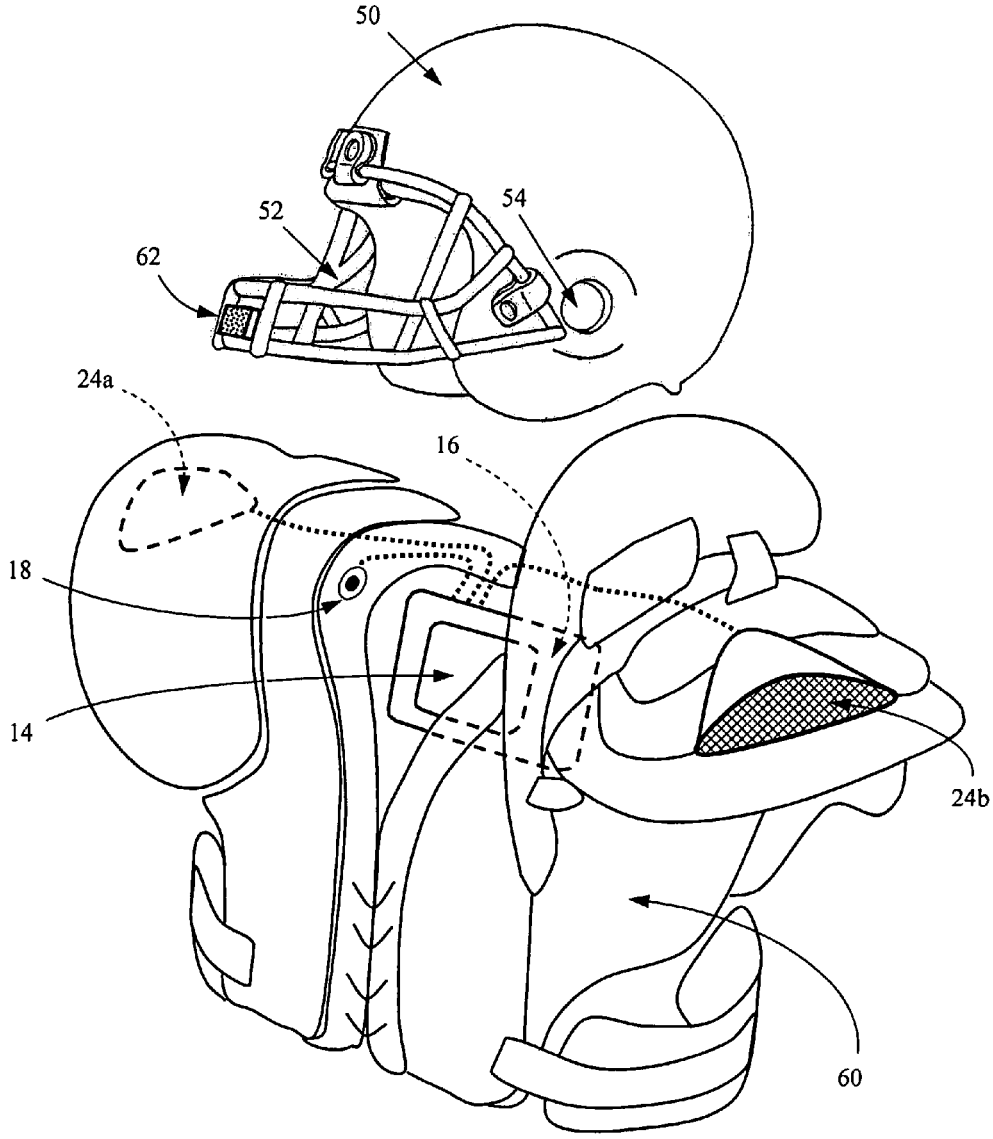
FIG. 7 is a perspective view of a further alternate preferred embodiment of the present invention where the signal line between the microphone component and the balance of the components in the system is wireless.

Reference is finally made to FIG. 7 for a further alternate embodiment of the present invention wherein connection between the microphone component of the system and the balance of the electronic components in the system is accomplished by wireless communication means. In FIG. 7 the only system component incorporated into helmet 50 is wireless microphone 62. Positioned in the facemask 52 of helmet 50, wireless microphone 62 integrates its own battery power supply and short distance radio frequency transmitter. Various standard short distance radio frequency transmission devices are known in the art as suitable for communicating a signal representing the voice of the user over short distances to loud speaker systems for re-broadcast.

In the embodiment shown in FIG. 7 the amplifier/controller circuitry 14 and power supply 16 are fully integrated into the shoulder pads of the user as described above in a manner similar to that shown in conjunction with FIG. 5. Likewise, broadcast speakers 24*a* and 24*b* are fully integrated into the shoulder pad equipment 60 of the user. In this instance, control switch 18 is likewise integrated into the shoulder pad equipment 60 and positioned at a point easily accessible by the user and not likely to be subject to adverse contact during the play of the game.

Amplifier/controller circuitry 14, in the embodiment shown in FIG. 7, would include, in this embodiment, appropriate radio frequency (RF) receiver circuitry for receiving the short distance RF transmission from wireless microphone 62. Over this short distance the power output from wireless microphone 62 would be minimal thus eliminating the need for frequent changing of the battery contained within wireless microphone 62.

The clear advantage of the system shown in FIG. 7 is, of course, the elimination of the electrical cabling between the helmet of the user and the shoulder pad equipment. A similar configuration could be implemented in conjunction with the system generally shown in FIG. 4 wherein the larger components of the system would all be integrated into a belt worn by the user. The same wireless microphone 62 shown in FIG. 7 could be used in conjunction with a belt system as shown in FIG. 4. Such a system would likewise integrate control switch 18 and an appropriate radio frequency receiver into the components positioned on the belt.

The amplifier/controller circuitry described in each of the above embodiments may incorporate a number of functional features that benefit the user under different sporting event conditions. One such feature, identified in FIG. 2 as timing circuit 20, serves to de-activate the voice communication system after a set period of use. Typically, the user would activate the system by manipulating control switch 18 at a time appropriate for such activation. Generally this occurs at the user's leisure and not during some immediate activity, motion, or action by the user. In the case of American football, the quarterback might activate the system as a play is about to be initiated. Approaching the line of scrimmage, the quarterback might activate or de-activate the system as might be required given the level of crowd noise or the need to alter the signal calling and alter the play to be executed.

In any event, it is generally desirable that at some point immediately after the signals have been called that the system be de-activated so that further communications not intended to be heard by opposing players are not inadvertently broadcast through the system. In American football, a time period of approximately 20 seconds or less is typically sufficient to allow the signal caller to approach the line of scrimmage, broadcast signals or alternate play information, and then terminate the operation of the system before any further communication is inadvertently broadcast. Other features may be integrated into the amplifier/controller circuitry such as selectively directing the amplified voice through one or more broadcast speakers depending upon which players on the team might require hearing such communications.

Although the present invention has been described in terms of the foregoing preferred embodiments, this description has been provided by way of explanation only, and is not intended to be construed as a limitation of the invention. Those skilled in the art will recognize modifications of the present invention that might accommodate specific sporting events and stadium environments. Those skilled in the art will further recognize additional methods for modifying the construction of the system to accommodate variations in the manner of placing the components of the system on or near the signal caller. Such modifications, as to structure, orientation, geometry, and even arrangement of the component elements of the system, where such modifications are coincidental to the type of sporting event environment, do not necessarily depart from the spirit and scope of the invention.

I claim:

1. A system for amplifying the voice of a sports team signal caller during the course of a sports competition to communicate information to other players on the signal caller's team despite a level of extraneous noise, the sports team signal caller wearing equipment comprising a protective helmet and protective shoulder pads, the system comprising:

a microphone positioned on the protective helmet worn by the sports team signal caller in a location for reception of the voice of the sports team signal caller when the sports team signal caller is calling signals during the course of the sports competition, the microphone comprising a wireless microphone communicating a radio frequency signal;

an electronic amplifier circuit positioned within the protective shoulder pads worn by the sports team signal caller, the electronic amplifier circuit receiving the radio frequency signal from the microphone;

a power supply connected to the electronic amplifier circuit and positioned within the protective shoulder pads worn by the sports team signal caller; and a plurality of broadcast loudspeakers positioned within the protective shoulder pads worn by the sports team signal caller and connected to the electronic amplifier circuit for re-broadcasting the amplified voice of the sports team signal caller to the other players on the signal caller's team, the plurality of broadcast loudspeakers comprising at least one loudspeaker oriented away from the sports team signal caller to the sports team signal caller's right, at least one loudspeaker oriented away from the sports team signal caller to the sports team signal caller's left, and at least one loudspeaker oriented away from the sports team signal caller in a direction generally orthogonal to the sports team signal caller's right and left.

2. The system of claim 1 further comprising at least one feedback speaker positioned adjacent the ears of the sports team signal caller.

3. The system of claim 1 further comprising a control switch positioned in conjunction with equipment worn by the sports team signal caller for activating or de-activating the operation of the system.

4. The system of claim 3 wherein the control switch further comprises a volume control.

5. The system of claim 1 further comprising a timer control circuit for de-activating the system after a pre-set period of activation.

* * * * *